US012729470B2

(12) United States Patent
Ryu et al.

(10) Patent No.: US 12,729,470 B2
(45) Date of Patent: Sep. 8, 2026

(54) METHOD OF MONITORING A DISPENSING ASSEMBLY OF A WASHING MACHINE APPLIANCE

(71) Applicant: Haier US Appliance Solutions, Inc., Wilmington, DE (US)

(72) Inventors: Seonghoon Ryu, Yongin (KR); Hyoyeol Maeng, Gyeonggi-do (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 54 days.

(21) Appl. No.: 18/630,627

(22) Filed: Apr. 9, 2024

(65) Prior Publication Data

US 2025/0314003 A1 Oct. 9, 2025

(51) Int. Cl.

| | |
|---|---|
| ***D06F 33/37*** | (2020.01) |
| ***D06F 23/04*** | (2006.01) |
| ***D06F 34/04*** | (2020.01) |
| ***D06F 34/22*** | (2020.01) |
| ***D06F 39/02*** | (2006.01) |
| ***D06F 39/08*** | (2006.01) |
| *D06F 103/22* | (2020.01) |
| *D06F 105/02* | (2020.01) |

(Continued)

(52) U.S. Cl.

CPC ..... *D06F 33/37* (2020.02); *D06F 23/04* (2013.01); *D06F 34/04* (2020.02); *D06F 34/22* (2020.02); *D06F 39/022* (2013.01); *D06F 39/088* (2013.01); *D06F 2103/22* (2020.02); *D06F 2105/02* (2020.02); *D06F 2105/42* (2020.02); *D06F 2105/58* (2020.02)

(58) Field of Classification Search

None

See application file for complete search history.

(56) References Cited

U.S. PATENT DOCUMENTS

| | | | |
|---|---|---|---|
| 10,508,375 | B2 | 12/2019 | Zattin et al. |
| 2015/0014352 | A1 | 1/2015 | Cocking et al. |

(Continued)

FOREIGN PATENT DOCUMENTS

| | | | |
|---|---|---|---|
| CN | 101649538 | A | 2/2010 |
| CN | 104233700 | B | 5/2018 |
| JP | 2014108304 | A | 6/2014 |

OTHER PUBLICATIONS

CN 112144225 A machine translation, Washing Machine, Imanari (Year: 2020).*

*Primary Examiner* — Cristi J Tate-Sims

(74) *Attorney, Agent, or Firm* — Dority & Manning, P.A.

(57) ABSTRACT

A method for operating a washing machine appliance, the washing machine appliance including a wash tub positioned within a cabinet, a dispensing assembly for selectively adding wash fluid to the wash tub, a conductivity sensor and a turbidity sensor positioned within the wash fluid, the method including initiating an operating cycle of the washing machine appliance, operating the dispensing assembly to dispense wash fluid into the wash tub, obtaining an electrical conductivity of the wash fluid using the conductivity sensor, obtaining a wash fluid turbidity of the wash fluid using the turbidity sensor, identifying a wash additive within the wash fluid based at least in part on the electrical conductivity and the wash fluid turbidity of the wash fluid, and implementing a responsive action in response to determining that a wash additive does not match the target wash additive.

20 Claims, 6 Drawing Sheets

(51) Int. Cl.
*D06F 105/42* (2020.01)
*D06F 105/58* (2020.01)

(56) References Cited

U.S. PATENT DOCUMENTS

2024/0209556 A1* 6/2024 Snook ..... D06F 34/08
2024/0392487 A1* 11/2024 Joo ..... D06F 33/38

* cited by examiner

| | AMBIENT AIR | DETERGENT | SOFTENER | BLEACH |
|---|---|---|---|---|
| CONDUCTIVITY | 0 | 2797 | 1800 | 8000 |
| TURBIDITY | 894 | 695 | 495 | 745 |

METHOD OF MONITORING A DISPENSING ASSEMBLY OF A WASHING MACHINE APPLIANCE

FIELD OF THE INVENTION

The present subject matter relates generally to washing machine appliances, or more specifically, to methods of monitoring the performance of a dispensing assembly in a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Conventional washing machine appliances have dispensing assemblies including multiple chambers for storing various wash additives. These wash additives are selectively dispensed by opening particular valves of a valve assembly to flush or otherwise inject the desired wash additives into the wash chamber. However, conventional dispensing assemblies may experience malfunctions where the water valve associated with a target wash additive remains closed or does not open fully at the desired time. Moreover, other water valves may be mistakenly opened, may be faulty, or may be stuck in an open position, thereby dispensing undesirable wash additives into the wash chamber. Current dispensing assemblies have no effective way of monitoring these issues with water valves or dispensing assemblies, resulting in the performance of operating cycles with undesirable additives and wash fluid mixtures.

Accordingly, a washing machine appliance with an improved dispensing assembly is desirable. More specifically, a method for detecting wash and/or rinse additives in real time within a wash tub and adjusting operation for improved performance and consumer satisfaction would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a method for operating a washing machine appliance is provided. The washing machine appliance includes a wash tub positioned within a cabinet, a dispensing assembly for selectively adding wash fluid to the wash tub, a conductivity sensor positioned within the wash fluid, and a turbidity sensor positioned within the wash fluid. The method includes initiating an operating cycle of the washing machine appliance, operating the dispensing assembly to dispense wash fluid into the wash tub, obtaining an electrical conductivity of the wash fluid using the conductivity sensor, obtaining a wash fluid turbidity of the wash fluid using the turbidity sensor, identifying a wash additive within the wash fluid based at least in part on the electrical conductivity and the wash fluid turbidity of the wash fluid, determining that the wash additive does not match a target wash additive, and implementing a responsive action in response to determining that the wash additive does not match the target wash additive.

In another exemplary embodiment, a washing machine appliance is provided including a wash tub positioned within a cabinet, a wash basket rotatably mounted within the wash tub and defining a wash chamber configured for receiving a load of clothes, a dispensing assembly for selectively adding wash fluid to the wash tub, the wash fluid comprising at least one of water or a wash additive, a sump positioned proximate a bottom of the wash tub for collecting the wash fluid, a conductivity sensor for measuring an electrical conductivity of the wash fluid collected in the wash tub, a turbidity sensor for measuring a wash fluid turbidity of the wash fluid collected in the wash tub, and a controller operably coupled to the dispensing assembly, the conductivity sensor, and the turbidity sensor. The controller is configured to initiate an operating cycle of the washing machine appliance, operate the dispensing assembly to dispense the wash fluid into the wash tub, obtain the electrical conductivity of the wash fluid using the conductivity sensor, obtain the wash fluid turbidity of the wash fluid using the turbidity sensor, identify the wash additive within the wash fluid based at least in part on the electrical conductivity and the wash fluid turbidity of the wash fluid, determine that the wash additive does not match a target wash additive, and implement a responsive action in response to determining that the wash additive does not match the target wash additive.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
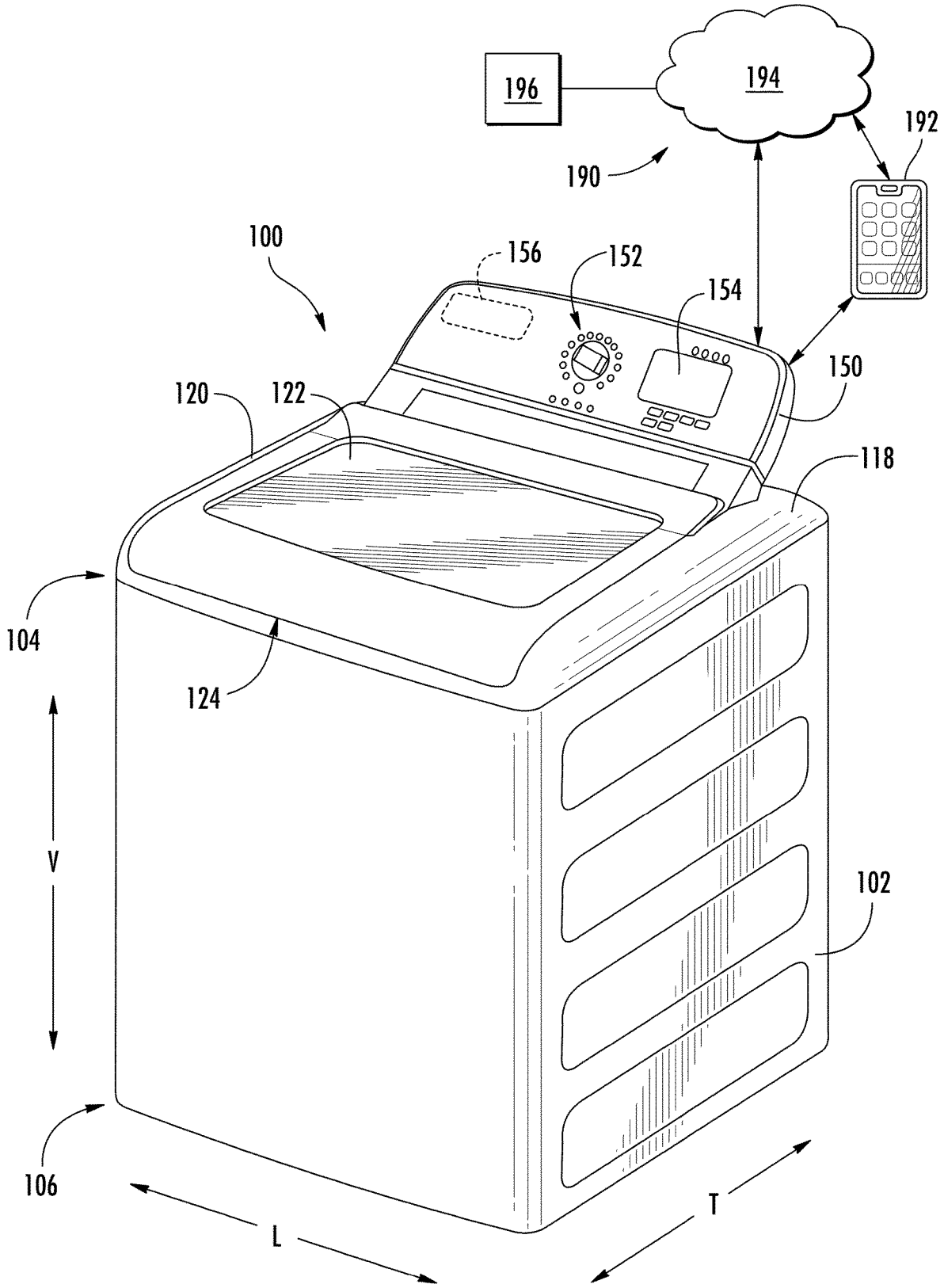
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
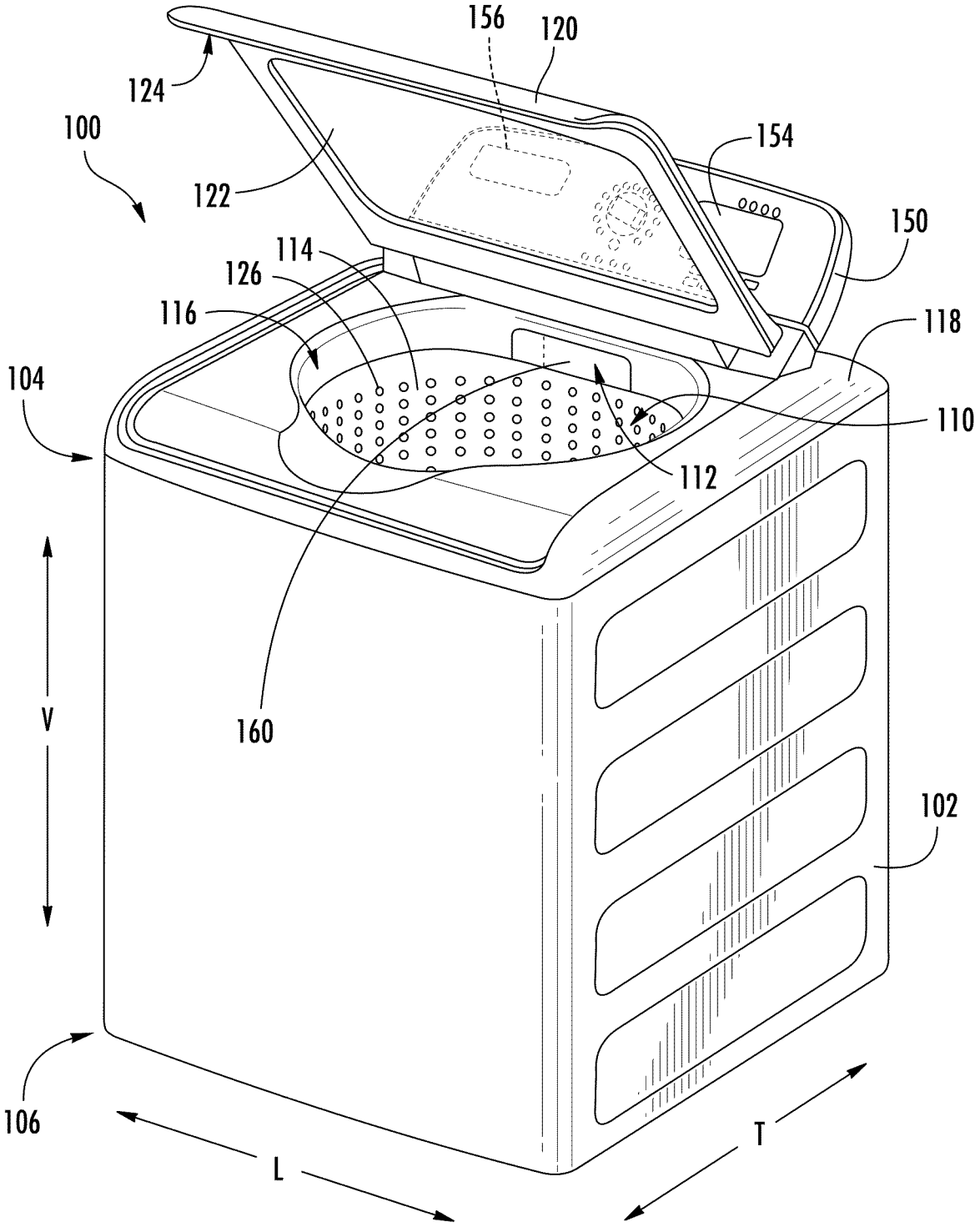
FIG. 2 provides a perspective view of the exemplary washing machine appliance of FIG. 1 with the door of the exemplary washing machine appliance shown in an open position.
Figure 3:
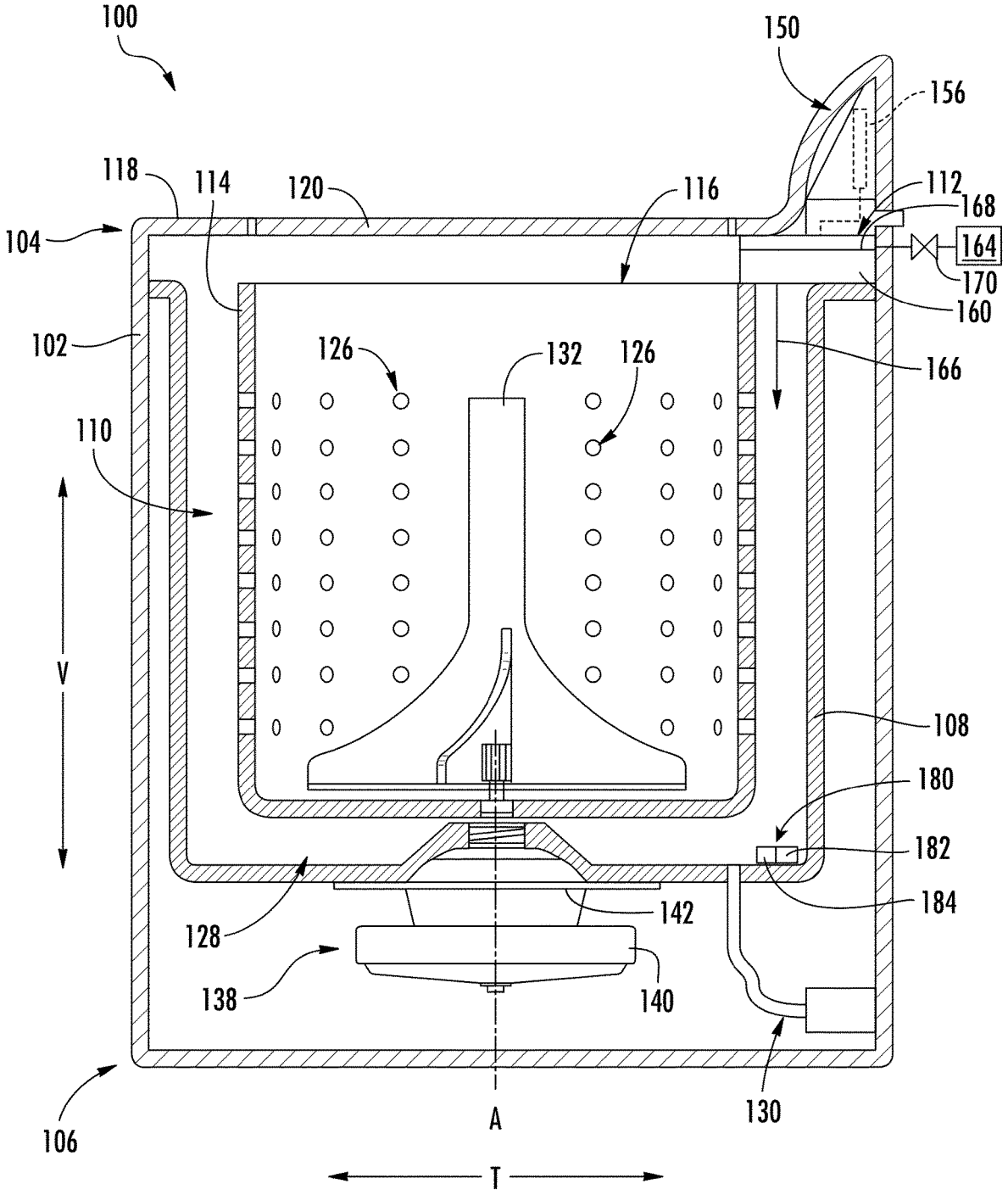
FIG. 3 provides a side cross-sectional view of the exemplary washing machine appliance of FIG. 1.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser or dispensing assembly 112 (FIG. 2) for dispensing wash fluid into wash tub 108.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 and/or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 100 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

After completion of the agitation cycle, washing machine appliance 100 may perform one or more rinse cycles. Specifically, according to an example embodiment, drain pump assembly 130 may drain the wash fluid from wash tub 108 and dispensing assembly 112 may dispense fresh water and/or a wash additive (such as fabric softener) into the wash tub. The load of clothes may then be agitated in the fresh water, e.g., to remove soil and detergent from load of clothes. After completion of the rinse cycle(s), drain pump assembly 130 may drain wash tub 108 and a spin cycle may be used to extract water from the clothes before the wash cycle is concluded.

Figure 4:
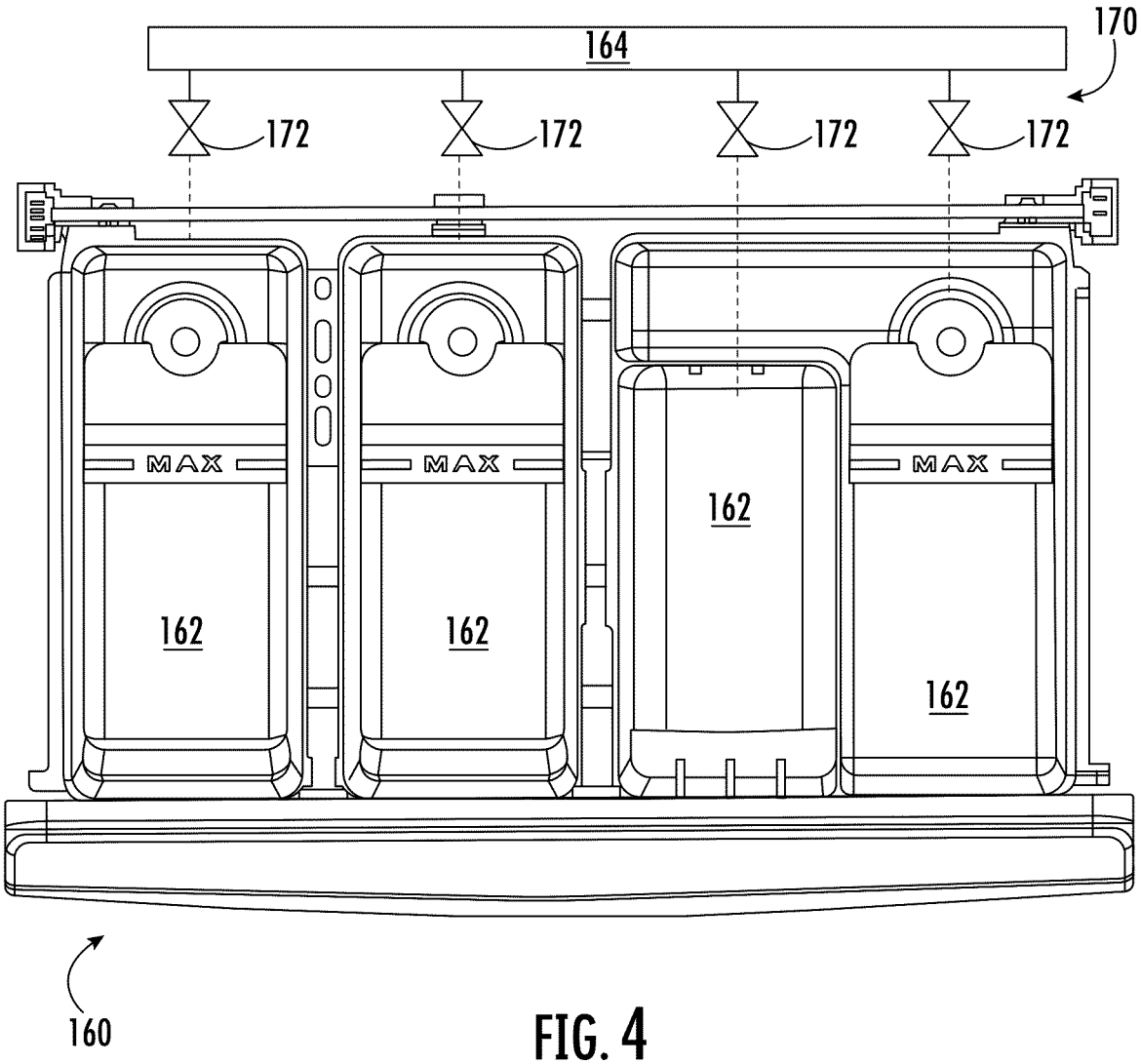
FIG. 4 provides a top view of a dispenser drawer of the example washing machine appliance of FIG. 1 according to an example embodiment of the present subject matter.

Referring now specifically to FIGS. 2 through 4, dispensing assembly 112 of washing machine appliance 100 will be described in more detail. As explained briefly above, dispensing assembly 112 may generally be configured to dispense wash fluid to facilitate one or more operating cycles or phases of an operating cycle (e.g., such as a wash cycle or a rinse cycle). The terms "wash fluid" and the like may be used herein to generally refer to a liquid used for washing and/or rinsing clothing or other articles. For example, the wash fluid is typically made up of water that may include other additives such as detergent, fabric softener, bleach, or other suitable treatments (including combinations thereof). More specifically, the wash fluid for a wash cycle may be a mixture of water, detergent, and/or other additives, while the wash fluid for a rinse cycle may be water only and/or additional rinse additives.

As illustrated, dispensing assembly 112 may generally include a dispenser drawer 160 that is slidably mounted within cabinet 102 for receiving one or more wash additives or detergents. In this regard, a user may slide detergent drawer 160 out from cabinet 102 for supplying wash additives needed for a wash cycle. In this regard, detergent drawer 160 may define one or more detergent chambers (e.g., identified herein generally by reference numeral 162).

Detergent chambers 162 may be generally configured for storing one or more wash additives for use during a washing cycle. For example, according to the illustrated embodiment, detergent drawer 160 defines a pre-wash chamber, a fabric softener chamber, a main wash chamber, and a detergent pod chamber. It should be appreciated that according to alternative embodiments, detergent drawer 160 may define other chambers for receiving other wash additives (e.g., such as bleach or other additives) while remaining within the scope of the present subject matter.

After additives have been supplied into detergent drawer 160, the user may slide detergent drawer 160 back into dispensing assembly 112 where a water supply 164 may selectively dispense fresh water to flush out one or more compartments of detergent drawer 160 and to create the flow of wash fluid 166 (FIG. 3). According to an example embodiment, a shower plate 168 may generally be positioned over detergent drawer 160 when detergent drawer 160 is inserted into dispensing assembly 112. According to an example embodiment, shower plate 168 may define a plurality of reservoirs that correspond to detergent chambers 162 and includes a plurality of water supply apertures (not shown) or perforations for discharging the freshwater from water supply 164 down into one or more detergent chambers 162. In this manner, fresh water and/or additives may be showered or flooded within dispenser drawer 160 where they may be mixed prior to passing into wash tub 108 (e.g., as flow of wash fluid 166).

As shown schematically in FIG. 3, dispensing assembly 112 may further include a valve assembly 170 including a plurality of freshwater supply valves 172 positioned at a rear of shower plate 168 for providing flows of hot and/or cold water into shower plate 168, e.g., from water supply 164. Controller 156 may selectively operate supply valves 172 to dispense water from water supply 164 into one or more reservoirs of shower plate 168. The flow of water may pass through shower plate 168 into one or more detergent chambers 162 to flush the detergent into wash tub 108 as the flow of wash fluid 166 at a desired time of the wash cycle and at a desired fluid temperature.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 130 may operate to discharge wash fluid from wash tub 108, e.g., to an external drain. After articles disposed in wash basket 114 are cleaned and/or washed, the user can remove the articles from wash basket 114, e.g., by reaching into wash basket 114 through opening 116.

Referring now specifically to FIG. 3, washing machine appliance 100 may include a sensor assembly 180 that includes one or more sensors for providing useful information regarding a particular load or operating cycle of the appliance. This information may be used for improved appliance performance, as described in more detail herein. For example, sensor assembly 180 may include a turbidity sensor 182, e.g., for monitoring the contaminant level or soil level of wash fluid 166, e.g., in order to determine the cleanliness of the clothes, to determine appropriate rinse parameters, or to identify wash additives added to the flow of wash fluid 166.

According to an example embodiment, turbidity sensor 182 may operate by using an emitter to emit a beam of light that is passed through wash fluid 166 and detecting the beam of light using a receiver. In this manner, the turbidity of wash fluid 166 may be estimated based on the distortion of the beam of light. Although turbidity sensor 182 is illustrated herein as including an emitter and receiver for generating and receiving a beam of light, it should be appreciated that this is only one exemplary embodiment. Any other suitable type or configuration of turbidity sensor may be used while remaining within the scope of the present subject matter. Other sensor configurations are possible and within the scope of the present subject matter.

In addition, sensor assembly 180 may be used to monitor the wash process using any other suitable sensors. For example, as illustrated, sensor assembly 180 may include a conductivity sensor 184 that is positioned in sump 128 and is configured for monitoring conductivity or other suitable parameters or conditions of the wash fluid 166. For example, conductivity sensor 184 may measure the electrical conductivity of the wash fluid 166. In addition, or alternatively, sensor assembly 180 may include other sensors, e.g., such as a pH sensor for measuring the pH of the wash fluid 166.

According to the illustrated embodiment, sensor assembly 180 may be mounted within sump 128 where it is capable of obtaining accurate reading of wash fluid 166 within wash tub 108. According to still other embodiments, sensor assembly 180 may alternatively be positioned within a drain line or in drain pump assembly 130, within a recirculation line or assembly, or at any other location where it is in contact with collected wash fluid 166. According to an example embodiment, conductivity sensor 184 and turbidity sensor 182 are embodied in a single sensor unit positioned within sump 128 of wash tub 108.

Referring still to FIG. 1, a schematic diagram of an external communication system 190 will be described according to an exemplary embodiment of the present subject matter. In general, external communication system 190 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 190 may be used to transfer data or other information to improve performance of one or more external devices or appliances and/or improve user interaction with such devices.

For example, external communication system 190 permits controller 156 of washing machine appliance 100 to communicate with a separate device external to washing machine appliance 100, referred to generally herein as an external device 192. As described in more detail below, these communications may be facilitated using a wired or wireless connection, such as via a network 194. In general, external device 192 may be any suitable device separate from washing machine appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with washing machine appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control washing machine appliance 100, etc. In addition, external device 192 and remote server 196 may communicate with washing machine appliance 100 to communicate similar information.

In general, communication between washing machine appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with washing machine appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machine appliances. In addition, aspects of the present subject matter may be utilized in a combination washer/dryer appliance.

Now that the construction of washing machine appliance 100 and the configuration of controller 156 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as horizontal axis washing machine appliances. In exemplary embodiments, the various method steps as disclosed herein may be performed by controller 156 or a separate, dedicated controller.

Specifically, method 200 includes, at step 210, initiating an operating cycle of a washing machine appliance. In this regard, continuing the example from above, controller 156 may initiate the performance of an operating cycle of washing machine appliance 100. According to example embodiments, the operating cycle may be one of a pre-wash cycle, a main wash cycle, a rinse cycle, or any other suitable series of operations performed by washing machine appliance 100. The request to initiate the operating cycle may be supplied by a user, e.g., via control panel 150 or by an external device 192 (e.g., via a software application on a mobile phone).

Notably, each operating cycle may preferably be performed with a wash fluid containing a specific concentration or amount of a specific wash additive or additives. Accordingly, step 220 may generally include operating a dispensing assembly to dispense wash fluid into a wash tub. For example, controller 156 may operate dispensing assembly 112 to provide a flow of wash fluid containing a target wash additive associated with the selected operating cycle. For example, controller 156 may regulate supply valves 172 of valve assembly 170 to provide the flow of wash fluid 166 including the target wash additive as described above.

Notably, controller 156 may be programmed to supply the desired volume and type of wash fluid 166 to facilitate performance of the operating cycle (e.g., including the desired amount or concentration of the target wash additive). Notably, this target wash additive may be received from a lookup table based on the selected operating cycle, may be obtained from a software application on external device 192, or may be determined in any other suitable manner. Notably, as explained briefly above, operating issues with dispensing assembly 112 and/or valve assembly 170 may result in the dispensing of the incorrect type or concentration of the target wash additive. Accordingly, aspects of the present subject matter are directed to features for identifying wash additives within the wash fluid in wash tub 108.

Specifically, step 230 may include obtaining an electrical conductivity of the wash fluid using a conductivity sensor. In addition, step 240 may include obtaining a wash fluid turbidity of the wash fluid using a turbidity sensor. In this regard, sensor assembly 180 may obtain the conductivity and the turbidity of wash fluid 166 after it has collected within wash tub 108, e.g., before performance of the operating cycle, during performance of operating cycle, or at any other suitable time. According to example embodiments, the electrical conductivity may be communicated to controller 156 e.g., in units of Siemens per meter (S/m) or any other suitable conductivity metric. According to example embodiments, the wash fluid turbidity may be communicated to controller 156 e.g., in units of Nephelometric Turbidity Units (NTU) or any other suitable turbidity metric.

Step 250 may generally include identifying a wash additive within the wash fluid based at least in part on the electrical conductivity and the wash fluid turbidity of the wash fluid. In this regard, as shown for example in FIG. 6, the electrical conductivity and/or wash fluid turbidity may vary depending on the additive present within wash fluid 166. By monitoring the conductivity and turbidity, controller 156 may make informed decisions as to which additive is present and/or at what concentration. For example, using the example values from FIG. 6, if the conductivity is equal to or similar to 2797 S/m and the wash fluid turbidity is equal to or similar to 695 NTU, controller 136 may deduce that detergent is present within wash fluid 166. By contrast, if the conductivity is equal to or similar to 8000 S/m and the wash fluid turbidity is equal to or similar to 745 NTU, controller 136 may deduce that bleach is present within wash fluid 166.

It should be appreciated that the conductivities and turbidities described herein are only examples intended to facilitate discussion of aspects of the present subject matter. In addition, it should be appreciated that the conductivity and/or turbidity need not match exactly for controller 156 to positively identify the wash additive. In this regard, for example, if the conductivity falls within a predetermined range surrounding a conductivity associated with a particular additive, controller 156 may positively identify that wash additive. It should be appreciated that these values may be stored in a lookup table, may be determined empirically, or may be determined in any other suitable manner.

Step 260 may generally include determining that the wash additive does not match a target wash additive. In this regard, the wash additive identified at step 250 may be compared to the target wash additive intended to be used with the operating cycle to determine whether they match or there is a mismatch. For example, determining that the wash additive does not match the target wash additive may include determining a target conductivity range and a target turbidity range associated with the wash fluid containing the target wash additive and determining that at least one of the electrical conductivity and the wash fluid turbidity of the wash fluid fall outside the target conductivity range and the target turbidity range, respectively.

Although step 250 explicitly recites identifying a specific wash additive and step 260 includes comparing the identified wash additive with the target wash additive, it should be appreciated that according to alternative embodiments, the wash additive need not be positively identified, but instead, the measured conductivities and turbidities may be used as proxies for this wash additive. Notably, in the event that step 260 results in a determination that the wash additive actually matches the target wash additive, controller 156 may proceed with performing the operating cycle using standard operating parameters associated with that operating cycle.

Step 270 may generally include implementing a responsive action in response to determining that the wash additive does not match the target wash additive. Implementing the responsive action in response to determining that the wash additive does not match the target wash additive may include providing a user notification that the wash additive does not match the target wash additive. For example, this user notification may be provided through a control panel 150, e.g., via display 154. According to still other embodiments, the user notification may be provided to a remote device 192 (e.g., such as a user's cell phone) using network 194.

Figures 6, 7:
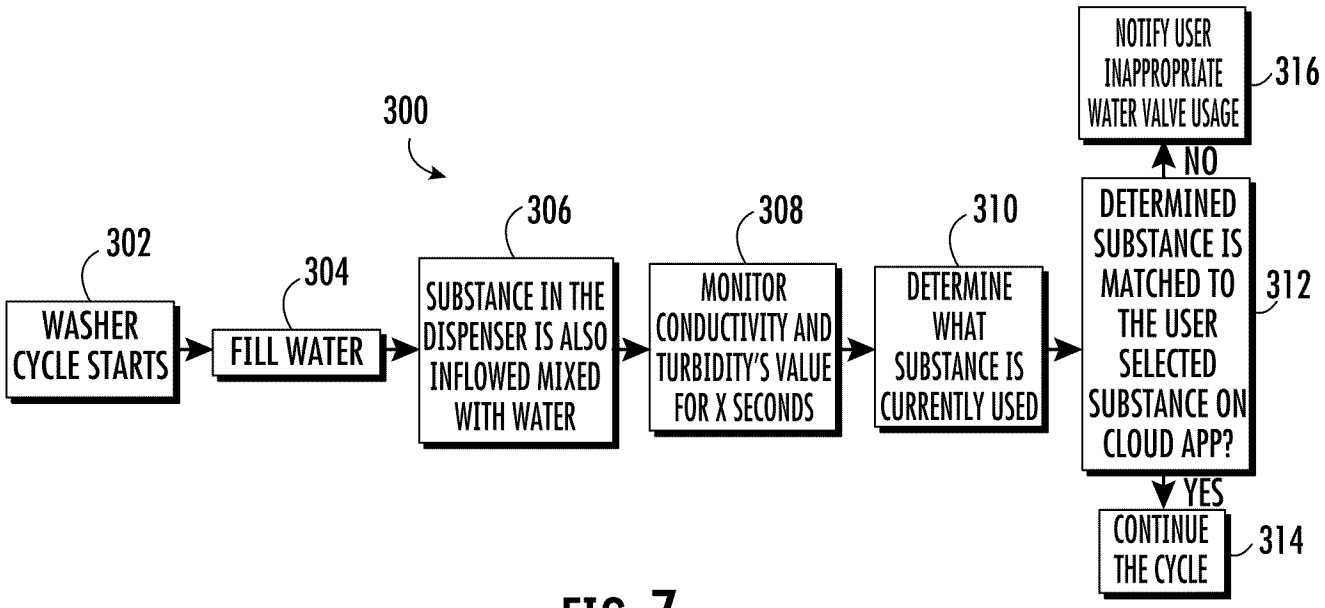
FIG. 6 is a table of measured conductivities and turbidities of wash fluid including various additives according to an example embodiment of the present subject matter.
FIG. 7 provides a flow diagram of an exemplary process for implementing dispenser monitoring in a washing machine appliance according to an exemplary embodiment of the present subject matter.

Referring now briefly to FIG. 7, an exemplary flow diagram is provided illustrating a wash additive detection process associated with an operating cycle of a washing machine appliance. As shown, step 302 includes the washing machine starting an operating cycle and step 304 includes filling the wash tub with water. Step 306 includes entraining or dispensing the wash additive within the mix of water to create a wash fluid having a wash additive. Step 308 includes monitoring the conductivity and turbidity of the wash fluid for a predetermined amount of time, e.g., such as 10 seconds. Step 310 includes determining what substances currently present within the wash fluid, e.g., based on the detected conductivity and/or turbidity. Step 312 includes determining whether the detected substance matches the user selected substance associated with the operating cycle. If the wash additive and the target wash additive match, step 314 may include proceeding with the operating cycle. By contrast, if the wash additive and the target wash additive do not match, step 316 may include notifying the user of an issue with valve assembly 170 or of the presence of an undesirable wash additive.

Figure 5:
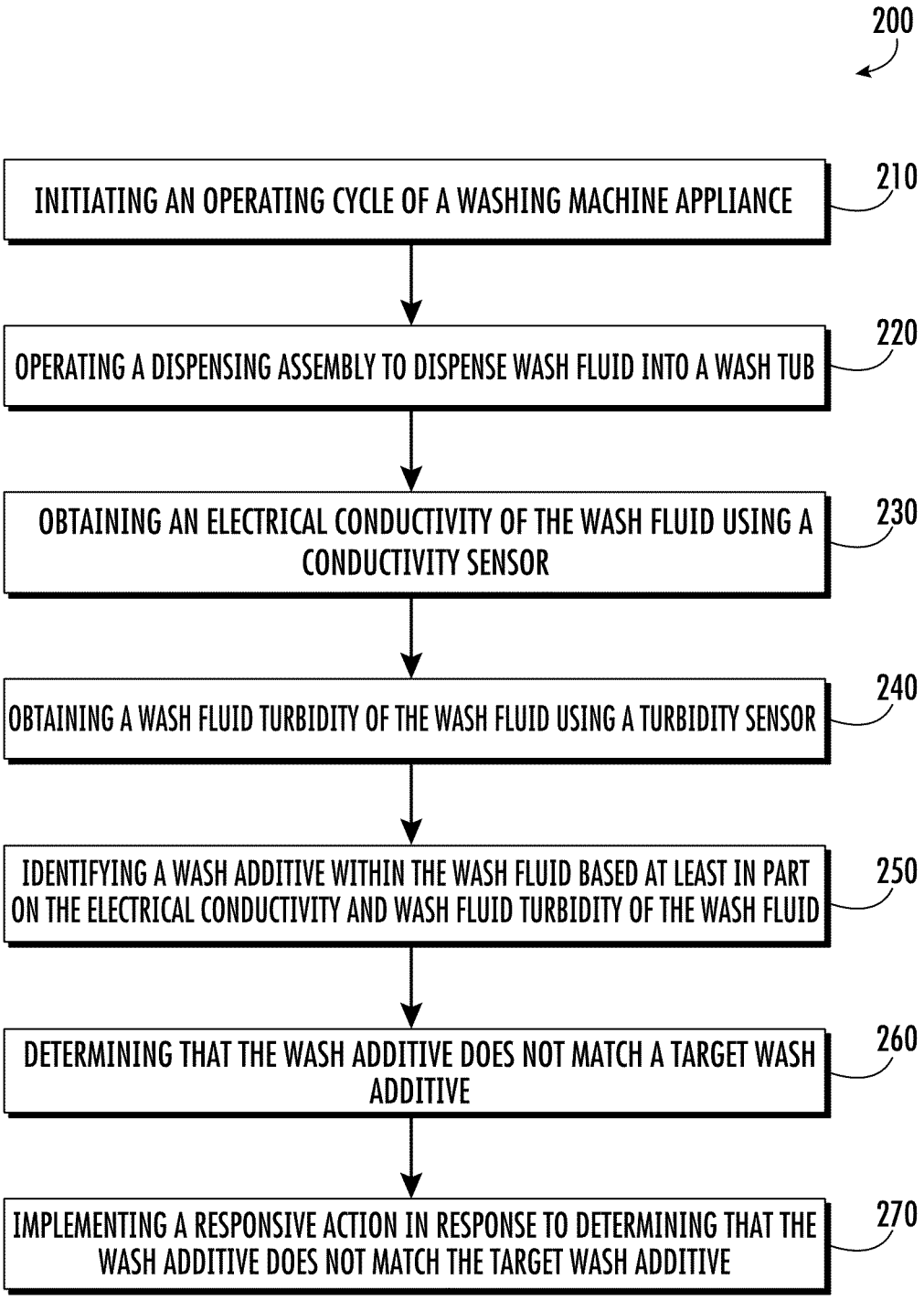
FIG. 5 illustrates a method for operating a washing machine appliance in accordance with one embodiment of the present disclosure.

FIGS. 5 and 7 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 and method 300 are explained using washing machine appliance 100 as an example, it should be appreciated that this method may be applied to the operation of any suitable laundry appliance, such as another washing machine appliance.

As explained herein, aspects of the present subject matter are generally directed to a top load washing machine with a sensor that is able to measure the conductivity and turbidity of wash fluid at the same time. Users may customize each wash step (e.g., pre-wash, main wash, rinse, etc.) with selected substance using a cloud-based software application, and the washing machine may perform an improved full washer cycle based on the user-selected substance type in multi-dispense-based flex tray. Water valves associated with each tray on the multiple dispensers can open at each wash step. When a washer cycle starts, the washer may begin checking the trend in conductivity and turbidity, may determine which substance is currently being used, and then may check which step washer is running. The washer may compare the determined substance to the user selected one (washer gets the user selected substance on cloud software application) and if there is a mismatch, the washer may stop the cycle and notify the user that the valve is incorrectly opened and that a cycle is running with an inappropriate substance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance comprising a wash tub positioned within a cabinet, a dispensing assembly for selectively adding wash fluid to the wash tub, a conductivity sensor positioned within the wash fluid, a turbidity sensor positioned within the wash fluid, and a pH sensor positioned within the wash fluid, the method comprising:

initiating an operating cycle of the washing machine appliance;

operating the dispensing assembly to dispense wash fluid into the wash tub;

obtaining an electrical conductivity of the wash fluid using the conductivity sensor;

obtaining a wash fluid turbidity of the wash fluid using the turbidity sensor;

obtaining a pH of the wash fluid using the pH sensor;

identifying a wash additive within the wash fluid based at least in part on the electrical conductivity, the wash fluid turbidity, and the pH of the wash fluid;

determining that the wash additive does not match a target wash additive; and implementing a responsive action in response to determining that the wash additive does not match the target wash additive.

2. The method of claim 1, wherein determining that the wash additive does not match the target wash additive comprises:

determining that the electrical conductivity is different than a target conductivity or the wash fluid turbidity is different than a target turbidity.

3. The method of claim 2, wherein the target conductivity and the target turbidity are obtained from a lookup table based on the target wash additive.

4. The method of claim 1, wherein determining that the wash additive does not match the target wash additive comprises:

determining a target conductivity range and a target turbidity range associated with the wash fluid containing the target wash additive; and determining that at least one of the electrical conductivity and the wash fluid turbidity of the wash fluid fall outside the target conductivity range and the target turbidity range, respectively.

5. The method of claim 1, wherein the dispensing assembly comprises a plurality of additive chambers and a plurality of water valves for dispensing the wash fluid into the wash tub, and wherein operating the dispensing assembly comprises:

opening one or more of the plurality of water valves to dispense the wash fluid with the wash additive.

6. The method of claim 1, wherein the operating cycle is one of a pre-wash cycle, a main wash cycle, or a rinse cycle.

7. The method of claim 1, further comprising:

receiving the target wash additive from a software application on a remote device.

8. The method of claim 1, further comprising:

determining that the wash additive matches the target wash additive; and performing the operating cycle.

9. The method of claim 1, wherein implementing the responsive action in response to determining that the wash additive does not match the target wash additive comprises:

providing a user notification that the wash additive does not match the target wash additive.

10. The method of claim 9, wherein the user notification is provided through a user interface panel of the washing machine appliance.

11. The method of claim 9, wherein the user notification is provided to a remote device using an external network.

12. A washing machine appliance, comprising:

a wash tub positioned within a cabinet;

a wash basket rotatably mounted within the wash tub and defining a wash chamber configured for receiving a load of clothes;

a dispensing assembly for selectively adding wash fluid to the wash tub, the wash fluid comprising at least one of water or a wash additive;

a sump positioned proximate a bottom of the wash tub for collecting the wash fluid;

a conductivity sensor for measuring an electrical conductivity of the wash fluid collected in the wash tub;

a turbidity sensor for measuring a wash fluid turbidity of the wash fluid collected in the wash tub;

a pH sensor positioned within the wash fluid; and a controller operably coupled to the dispensing assembly, the conductivity sensor, and the turbidity sensor, the controller being configured to:

initiate an operating cycle of the washing machine appliance;

operate the dispensing assembly to dispense the wash fluid into the wash tub;

obtain the electrical conductivity of the wash fluid using the conductivity sensor;

obtain the wash fluid turbidity of the wash fluid using the turbidity sensor;

obtaining a pH of the wash fluid using the pH sensor;

identify the wash additive within the wash fluid based at least in part on the electrical conductivity, the wash fluid turbidity, and the pH of the wash fluid;

determine that the wash additive does not match a target wash additive; and implement a responsive action in response to determining that the wash additive does not match the target wash additive.

13. The washing machine appliance of claim 12, wherein determining that the wash additive does not match the target wash additive comprises:

determining that the electrical conductivity is different than a target conductivity or the wash fluid turbidity is different than a target turbidity.

14. The washing machine appliance of claim 13, wherein the target conductivity and the target turbidity are obtained from a lookup table based on the target wash additive.

15. The washing machine appliance of claim 12, wherein determining that the wash additive does not match the target wash additive comprises:

determining a target conductivity range and a target turbidity range associated with the wash fluid containing the target wash additive; and determining that at least one of the electrical conductivity and the wash fluid turbidity of the wash fluid fall outside the target conductivity range and the target turbidity range, respectively.

16. The washing machine appliance of claim 12, wherein the dispensing assembly comprises a plurality of additive chambers and a plurality of water valves for dispensing the wash fluid into the wash tub, and wherein operating the dispensing assembly comprises:

opening one or more of the plurality of water valves to dispense the wash fluid with the wash additive.

17. The washing machine appliance of claim 12, wherein the controller is further configured to:

determine that the wash additive matches the target wash additive; and perform the operating cycle.

18. The washing machine appliance of claim 12, wherein the controller is further configured to:

receive the target wash additive from a software application on a remote device.

19. The washing machine appliance of claim 12, wherein implementing the responsive action in response to determining that the wash additive does not match the target wash additive comprises:

providing a user notification that the wash additive does not match the target wash additive.

20. The washing machine appliance of claim 13, wherein the conductivity sensor and the turbidity sensor are embodied in a single sensor unit positioned within the sump of the wash tub.

* * * * *